United States Patent [19]

Langlie et al.

[11] Patent Number: 4,883,923

[45] Date of Patent: Nov. 28, 1989

[54] ELECTRIC FENCE INSULATOR FOR HOLDING VARIOUS CONDUCTOR TYPES, INCLUDING TAPE-TYPE

[75] Inventors: Ronald H. Langlie; Jon A. Berg, both of Ellendale, Minn.

[73] Assignee: North Central Plastics, Incorporated, Ellendale, Minn.

[21] Appl. No.: 343,393

[22] Filed: Apr. 21, 1989

[51] Int. Cl.[4] ..... H01B 17/14

[52] U.S. Cl. ..... 174/158 F; 174/171; 174/175

[58] Field of Search ..... 174/158 F, 161 F, 163 F, 174/171, 175; 256/10, 47, 48, 52; D13/17, 18

[56] References Cited

U.S. PATENT DOCUMENTS

| | | | |
|---|---|---|---|
| 3,749,820 | 7/1973 | Langlie et al. | 174/163 F |
| 3,752,902 | 8/1973 | Wilson | 174/175 X |
| 3,820,758 | 6/1974 | Berg, Jr. et al. | 174/163 F X |
| 4,028,489 | 6/1977 | Berg, Jr. et al. | 174/158 F X |
| 4,077,611 | 3/1978 | Wilson | 174/163 F X |
| 4,599,488 | 7/1986 | Wilson, Jr. | 174/158 F |

FOREIGN PATENT DOCUMENTS

| | | | |
|---|---|---|---|
| 153325 | 5/1938 | Austria | 174/171 |
| 1185906 | 2/1959 | France | 174/175 |
| 1531314 | 5/1968 | France | 174/175 |

*Primary Examiner*—Laramie E. Askin

*Attorney, Agent, or Firm*—Peterson, Wicks, Nemer & Kamrath

[57] ABSTRACT

The electric fence insulator is of linear polyethylene. The insulator includes a vertical panel having a first L-shaped clip thereon providing a downwardly directed prong. A pair of laterally spaced L-shaped clips provide a pair of upwardly directed prongs each having a rib extending therealong. The ribs render these last-mentioned prongs relatively rigid with respect to the downwardly extending prong. The downwardly extending prong has its lower end at an elevation beneath the elevation of the upper ends of the upwardly extending prongs to assure retention of an electric fence conductor by reason of the overlapping prongs.

12 Claims, 3 Drawing Sheets

3
3
18
12
16
22a
22
20
10
22b
28
28b
26b
26d
26
14
24a
24
24d
24b
26a
28a

ELECTRIC FENCE INSULATOR FOR HOLDING VARIOUS CONDUCTOR TYPES, INCLUDING TAPE-TYPE

BACKGROUND OF THE INVENTION

This invention relates generally to electric fence insulators, and pertains more particularly to an insulator for holding various types of electric fence conductors, especially the more recently employed braided tape-type of conductor composed of interwoven plastic and metal strands.

Inasmuch as several types of conductors for electric fences are rather widely used, a need exists for an electric fence insulator that will accommodate and securely anchor all of the conductor types. More specifically, electric fences have widely used plain bare wire, barbed wire and a flexible wire of twisted plastic and metal strands; but with the advent of the tape-type conductor, the desirability of having an insulator capable of holding all four conductor types has arisen.

SUMMARY OF THE INVENTION

Accordingly, an important object of the present invention is to provide an electric fence insulator that will effectively and securely anchor all of the present-day types of conductors.

Another object of the invention is to provide an electric fence insulator in which the conductor can be quickly attached, and also easily removed if the occasion later arises for doing so.

Electric fences traverse various terrains. More specifically, sometimes, one or more posts are located in a valley and at other times on the crest of a hill. When in a valley, there is a pull on the electric conductor tending to raise the conductor; and, conversely, when on a crest of a hill, the conductor is pulled downwardly. The present electric insulator assures that the conductor will be reliably held in place irrespective of the contour of the land.

Yet another object of the invention is to provide an electric fence insulator that can be mass produced at a relatively low cost, thereby encouraging its widespread use by farmers and ranchers.

Still another object of the invention is to provide an electric fence insulator that will not only securely hold in place various types of electric fence conductors, but which can be specifically fabricated so as to be attached to any of the variety of fence posts commonly encountered on farms, ranches and ranges. In this regard, our insulator lends itself readily to incorporation into insulators that are intended to be attached to wooden fence posts, round metal posts, and also T-shaped metal posts. More specifically, an aim of the invention is to provide an electric insulator having means incorporated therein for enabling an electric fence conductor to be front loaded and the body portion of the insulator factory adapted for the particular post on which the insulator is to be mounted.

Briefly, the insulator described and claimed herein comprises three clips, one including a downwardly directed prong and the other two including upwardly directed prongs, the prongs forming slots in conjunction with a vertical panel that is integral with the body of the insulator. The lower, free end of the downwardly directed prong is beneath the upper ends of the upwardly directed prongs to assure that the electric fence conductor, irrespective of its type, is securely held in place. Each upwardly directed prong is made more rigid than the downwardly directed prong by means of an integral rib extending longitudinally therealong.

DESCRIPTION OF THE PREFERRED EMBODIMENT

Figure 1:
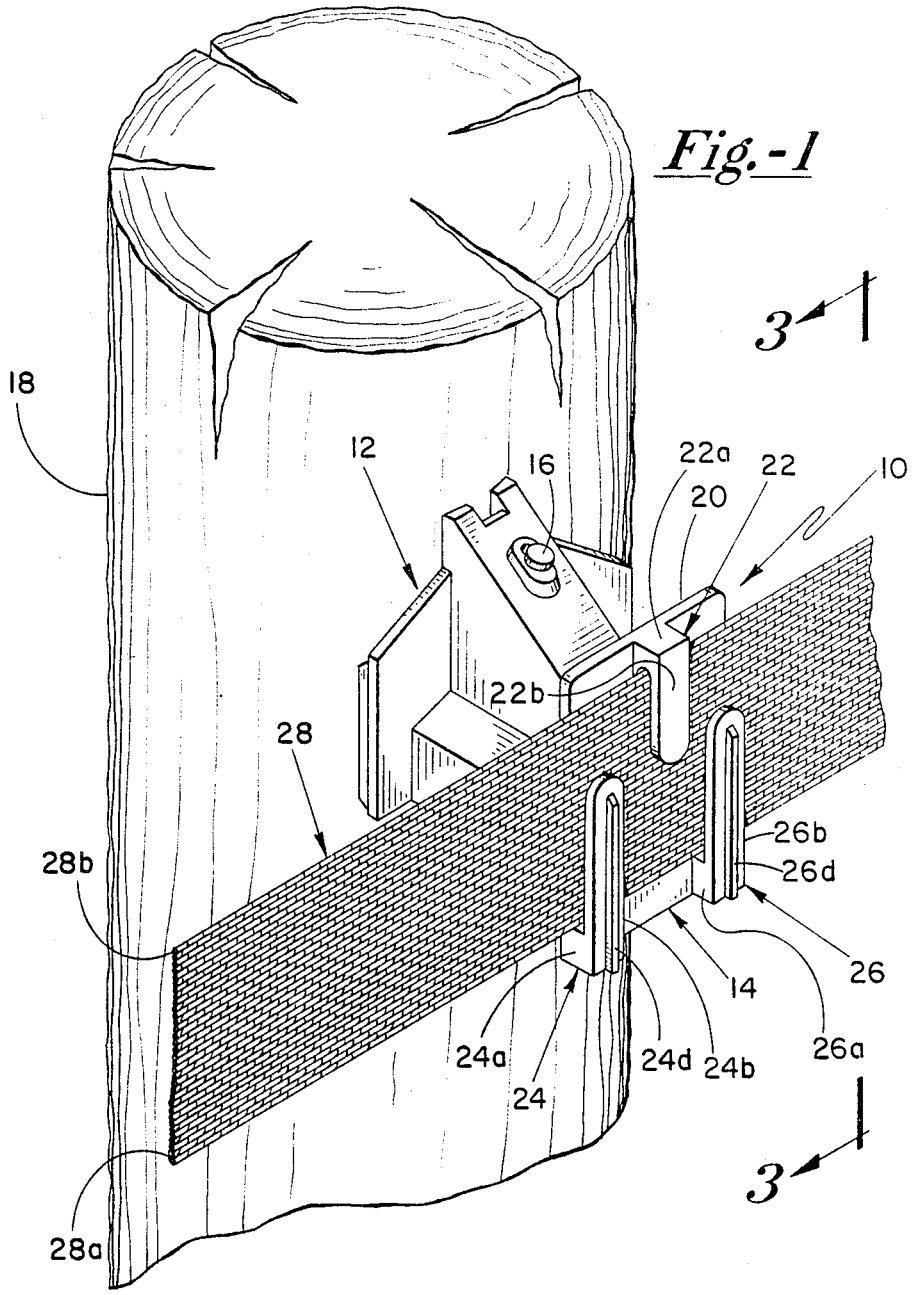
FIG. 1 is a perspective view of an electric fence insulator exemplifying our invention, the insulator holding a tape-type conductor.

The electric fence insulator has been denoted generally by the reference numeral 10. The insulator 10 includes a body 12 and conductor-holding means 14 which will be presently described in detail. It will be observed that the insulator 10 is attached by a nail 16 to a wooden post 18. The body 12 of the insulator 10 corresponds to that shown in U.S. Pat. No. 4,028,489 granted on June 7, 1977 to Albert T. Berg, Jr. et al for "Plastic Nail-On Electric Fence Insulator." The insulator 10 may also be designed to be mounted on a metal round post and in such a case reference can be made to U.S. Pat. No. 3,749,820 issued July 31, 1973 to Howard Langlie et al for "Electric Fence Insulator." When the insulator 10 is intended for mounting on a T-shaped post, reference may be made ot U.S. Pat. No. 3,820,758 granted on June 28, 1974 to Albert T. Berg, Jr. et al for "Electric Fence Insulator For T-Shaped Posts." As the description progresses, it will be clear that the invention is not restricted to the particular type of posts for the electric fence insulator 10 can be molded to render it suitable for any one of the several posts frequently encountered as far as electric fences are concerned. It perhaps should be mentioned at this stage, though, that the insulator 10 is preferably fabricated from linear polyethylene plastic.

Having presented the foregoing information, a detailed description of the conductor-holding means 14 will now be given. The means 14 includes a vertical panel 20 that is integral with the body 12. The forward face of the panel 20 has mounted thereon an inverted L-shaped clip 22 comprised of a horizontal leg portion **22*a* integral with the vertical panel 20 and projecting horizontally therefrom, and also a vertical leg portion 22*b* that extends downwardly from the forward end of the horizontal leg portion 22*a*, thereby forming a downwardly facing slot 22*c***.

An upright L-shaped clip 24 has a horizontal leg portion **24*a* extending forwardly from the vertical panel 20 adjacent its lower edge and a vertical leg portion 24*b* extending upwardly, thereby forming an upwardly directed slot 24*c*. A reinforcing rib 24*b* is integral with the vertical leg portions 24*b***.

A similar upright L-shaped clip 26 is utilized having a horizontal leg portion **26*a* and a vertical leg portion 26*b*, the portions 26*a* and 26*b* forming a slot 26*c* corresponding to the slot 24*c*. As with the upright L-shaped clip 24, the vertical leg portion 26*b* has a reinforcing rib 26*d*** thereon.

Figure 4:
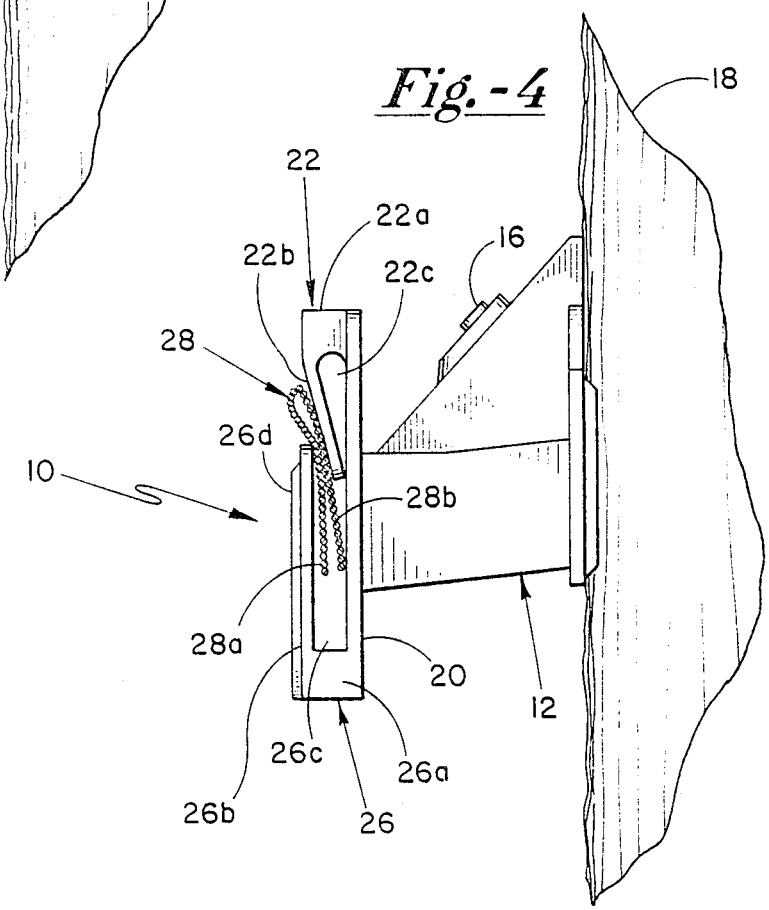
FIG. 4 is a view taken in the direction of line 4—4 of FIG. 2.

It can be now explained that the vertical leg portion **22*b* constitutes a relatively resilient prong that can be flexed toward the vertical panel 20. However, the vertical leg portions 24***b* and 26*b*, constituting additional prongs, of the L-shaped clips 24 and 26 are rendered relatively rigid by virtue of their reinforcing ribs 24*d* and 26*d*. As perhaps best perceived from FIG. 4, the lower end of the leg portion or prong 22 *b* is beneath the upper ends of the vertical leg portions or prongs 24*b* and 26*b*. This relationship is particularly important in assuring that whatever type of electric fence conductor is employed, it will be securely held or anchored by the insulator 10.

Inasmuch as the insulator 10 lends itself readily to holding the braided tape-type of conductor, such a conductor has been illustrated and has been given the reference number 28, being called "poly tape" in the trade. For the sake of describing better how the tape 28, when relatively wide, is anchored or held, it has been labeled in FIGS. 2 and 4 as including two folded portions 28*a* and 28*b*. Although the portions 28*a* and 28*b* are no longer folded in FIGS. 1 and 3, for the sake of consistency, the portions 28*a* and 28*b* have been so labeled even though the tape 28 is in a planar condition in FIGS. 1 and 3.

Figure 2:
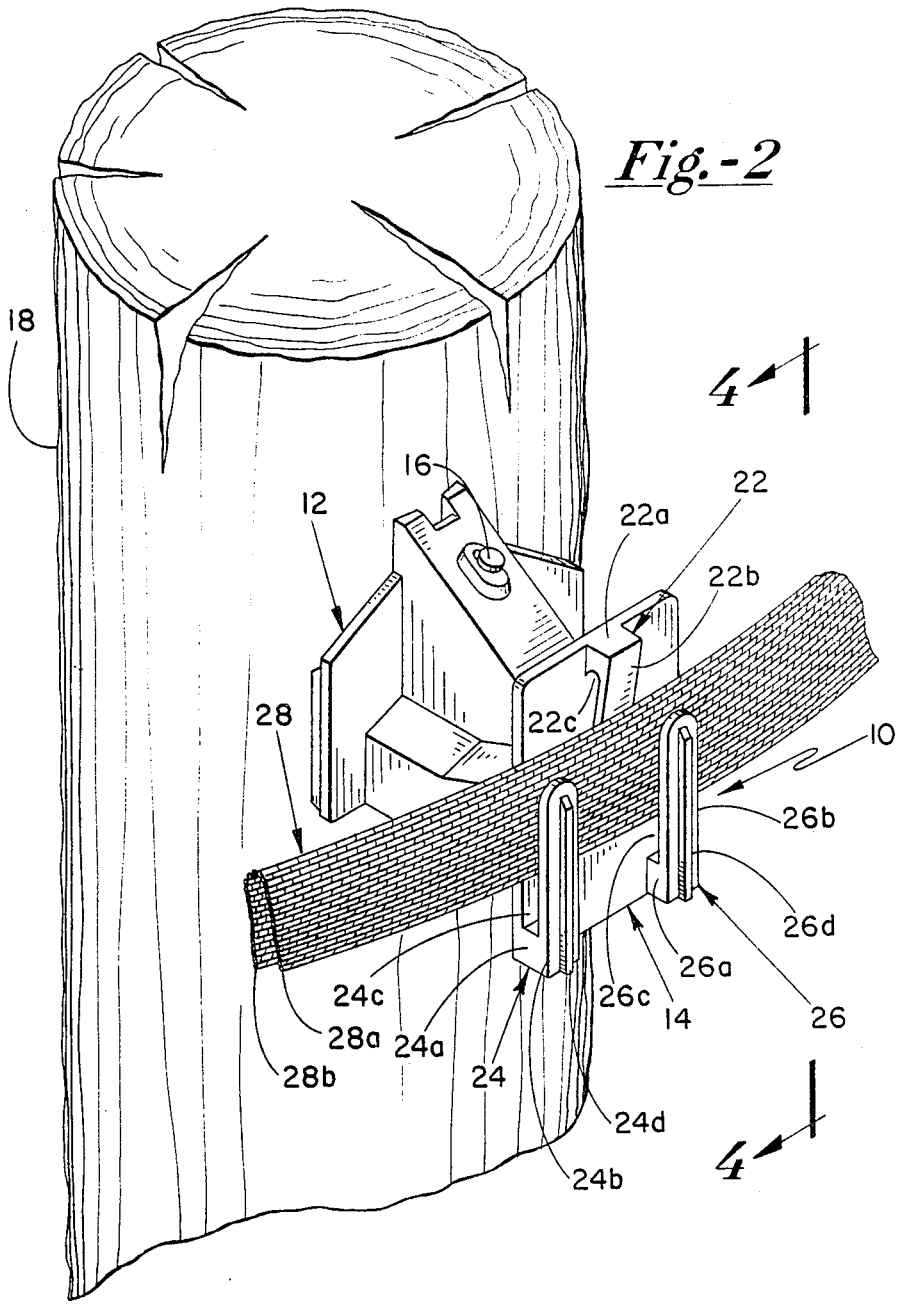
FIG. 2 is a perspective view showing how the tape is loaded.
Figure 3:
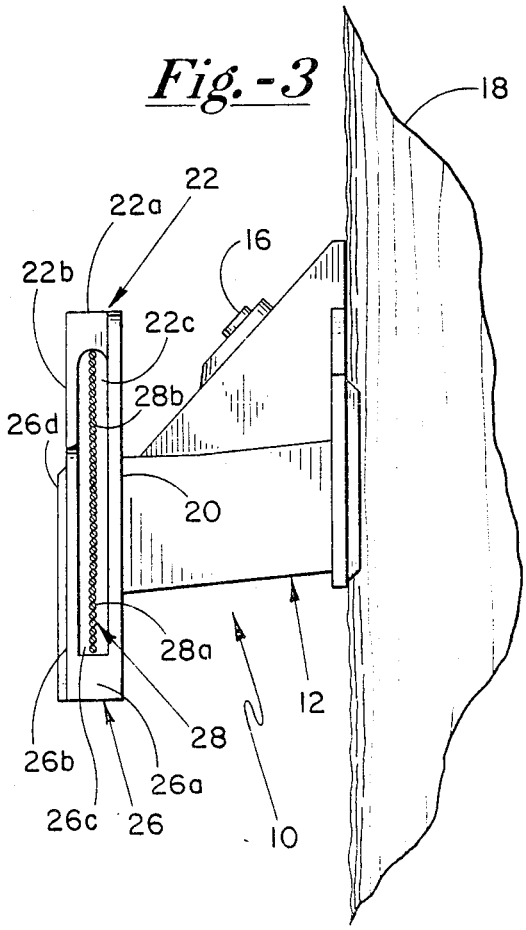
FIG. 3 is a view taken in the direction of line 3—3 of FIG. 1.

Describing now the ease with which the relatively wide tape 28 can be anchored by the holding means 14, attention is directed to FIG. 2 in which it is most convenient, when the tape has an appreciable width, to fold the tape 28 so as to provide the folded portions 28*a* and 28*b* that have just been described. By grasping, even though the person's hands are not pictured, the farmer or rancher can press the folded tape 28 against the leg portion or prong 22*b*, flexing it inwardly as can be seen to some extent in FIG. 2 but which can be more readily appreciated from FIG. 4. Downward movement of the folded tape 28 into the slots 24*c* and 26*c* will then allow the leg portion or prong 22*b* to flex or return to its substantially planar relationship with the leg portions or prongs 24*b* and 26*b*. The portions or prongs 24*b* and 26*b* are relatively rigid by reason of the ribs 24*d* and 26*d* extending upwardly therealong. Once the tape 28 has been fully inserted into the slots 24*c* and 26*c*, it can then be unfolded so that the planar condition thereof in FIGS. 1 and 3 is achieved.

It might be pointed out that the width (height as viewed in FIGS. 1 and 3) varies in actual practice. A common width is one-half inch, but the electric fence insulator 10 can accommodate wider widths, such as the greater width of the tape 28. In practice, the vertical distance or spacing between the leg portions 22*a* and 24*a*, 26*a* is one-and-a-half inches. Since the greatest width of poly tapes is on the order of one inch, even though a wider tape is illustrated, it follows that the insulator 10 will accommodate not only those commonly found on the market nowadays, but even wider ones that might be marketed in the future.

It will help, it is believed, to give actual dimensions for the leg portions or prongs 22*b*, 24*b* and 26*b*. The length of the portion or prong 22*b* in actual practice is three-quarters of an inch, whereas the length of the portions or prongs 24*b* and 26*b* is one inch. Hence, there is an overlap of one-quarter inch between the free ends of the portions 22*b*, 24*b* and 26*b*. Such an amount of overlap assures that the tape 28 will be held captive; however, a lesser amount of overlap will suffice in some instances. It is important that there be at least some overlap, though—at least one-eighth inch.

If the insulator 10 is attached to a post located in a valley, an upward pull on the tape 28 will simply cause the upper edge of the tape 28 to bear against the horizontal leg portion 22*a*, whereas if the insulator 10 is located on the crest of a hill, the lower edge thereof will bear against the horizontal leg portions 24*a* and 26*a*.

Having the foregoing description in mind, it should be readily apparent that wires or conductors of various types can be received and effectively anchored in the holding means 14. All that need be done is to flex the portion or prong 22*b* inwardly and then move the conductor downwardly into the lower slots 24*c* and 26*c*. When the conductor is in the form of the relatively wide tape 28, it can be unfolded so that it is retained by the three portions or prongs 22*b*, 24*b* and 26*b*. Hence, the insulator 10 herein described is quite versatile as far as the type of electric fence conductor it effectively anchors in place.

What is claimed is:

1. In combination with a tape-type conductor, an electric fence insulator comprising a body having means disposed at the rear thereof for attaching the body to a fence post, a forwardly facing panel on said body providing a flat surface residing in one plane, and a pair of oppositely directed L-shaped clips on said body, said clips including vertical leg portions forming prongs offset forwardly from the face of said panel and having flat surfaces residing in a rearwardly facing second plane parallel to and spaced forwardly of said one plane, one side of said tape-type conductor confronting the flat surface of said forwardly facing panel and being in a plane closely parallel to said panel, and the other side of said tape-type conductor confronting the rearwardly facing surfaces of said prongs, one of said prongs being more resilient than the other to permit flexing thereof toward said panel to facilitate insertion of said tape so as to achieve the confronting relationship of said tape with respect to said forwardly facing panel and the rearwardly facing flat surfaces of said prongs.

2. The combination in accordance with claim 1 in which said one prong extends downwardly from an upper location on said panel and in which said other prong extends upwardly from a lower location on said panel, the rearwardly facing flat surfaces of said prongs forming slots with the forwardly facing flat surface of said panel, a portion of said tape-type conductor being received in said slots.

3. The combination in accordance with claim 2 in which each prong has a free end, the free end of said one prong being lower than the free end of said other prong so as to provide an overlapping relationship of said prongs.

4. The combination in accordance with claim 3 in which said prongs are laterally offset with respect to each other.

5. The combination in accordance with claim 1 including a longitudinal rib integral with the forwardly facing surface of said other prong, said one prong being devoid of a longitudinal rib to render it more resilient than said other prong.

6. A plastic electric fence insulator comprising a body, a panel integral with said body, said panel having a forwardly facing flat surface residing in a first plane, first, second, and third prongs, each having a flat surface, first means adjacent the upper edge of said panel centrally retaining said first prong in a forwardly offset and downwardly directed relation with said panel so that its flat surface faces rearwardly and resides in a second plane spaced forwardly of said first plane, second means adjacent the lower edge of said panel and toward one side edge thereof retaining said second prong in a forwardly offset and upwardly directed relation with said panel so that its flat surface faces rearwardly and also resides in said second plane, and third means adjacent the lower edge of said panel and toward the other side edge thereof retaining said third prong in a forwardly offset and upwardly directed relation with said panel so that its flat surface faces rearwardly and also resides in said second plane, whereby a tape-type conductor when held by the insulator will have one side thereof facing the flat surface of said panel and closely adjacent thereto, and will have the other side thereof facing the flat surfaces of said prongs and closely adjacent thereto.

7. A plastic electric fence insulator in accordance with claim 6 in which the lower end of said first prong and its flat surface is at an elevation beneath that of the upper ends of said second and third prongs and their flat surfaces.

8. A plastic electric fence insulator in accordance with claim 7 in which said first prong is shorter than said second and third prongs.

9. A plastic electric fence insulator in accordance with claim 7 including a vertically disposed rib on the other sides of each of said second and third prongs.

10. An electric fence insulator comprising a panel having a forwardly facing flat surface, first, second and third prongs, means mounting said first prong in a vertical position and forwardly spaced from the flat surface of said panel so as to form a downwardly directed slot, means mounting said second prong in a vertical position and forwardly spaced from the flat surface of said panel so as to form an upwardly directed slot, and means mounting said third prong in a vertical position and forwardly spaced from the flat surface of said panel so as to form an upwardly directed slot, said first prong being more resilient than said second and third prongs, said second and third prongs each having a longitudinal rib integral therewith to make said second and third prongs more rigid than said first prong and thus render said first prong more resilient than said second and third prongs, and said second and third prongs being laterally displaced relative to said first prong.

11. An electric fence insulator in accordance with claim 10 in which the slots formed by said second and third prongs are longer than the slot formed by said first prong.

12. An electric fence insulator in accordance with claim 11 in which the lower end of said first prong extends beneath the upper ends of said second and third prongs.

* * * * *